US009365068B2

(12) United States Patent
Numakura

(10) Patent No.: US 9,365,068 B2
(45) Date of Patent: Jun. 14, 2016

(54) IMAGE PROCESSING APPARATUS AND IMAGE PROCESSING METHOD

(71) Applicants: KABUSHIKI KAISHA TOSHIBA, Tokyo (JP); TOSHIBA TEC KABUSHIKI KAISHA, Tokyo (JP)

(72) Inventor: Yoshikatsu Numakura, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/816,672

(22) Filed: Aug. 3, 2015

(65) Prior Publication Data

US 2016/0067998 A1 Mar. 10, 2016

(30) Foreign Application Priority Data

Sep. 5, 2014 (JP) ..... 2014-181502

(51) Int. Cl.
*B41J 29/38* (2006.01)
*B41M 7/00* (2006.01)

(52) U.S. Cl.
CPC ..... *B41M 7/0009* (2013.01)

(58) Field of Classification Search
CPC ..... B41J 2/01; B41J 29/38; B41M 7/0009
See application file for complete search history.

(56) References Cited

U.S. PATENT DOCUMENTS 8,478,151 B2 7/2013 Iguchi et al.
2011/0305851 A1* 12/2011 Wang ..... B41M 5/52 428/32.31
2013/0258026 A1* 10/2013 Iguchi ..... B41M 7/0009 347/179

* cited by examiner

*Primary Examiner* — Thinh Nguyen
(74) *Attorney, Agent, or Firm* — Patterson & Sheridan, LLP

(57) ABSTRACT

According to one embodiment, an image processing apparatus includes an image processing unit and a control unit. The image processing unit acquires information of a printing rate representing a ratio of an image printed on a sheet from the sheet. The control unit determines a decoloring temperature used for a decoloring process based on the acquired information of the printing rate.

15 Claims, 9 Drawing Sheets

| PRINTING RATE (%) | TEMPERATURE (℃) | |
|---|---|---|
| 0～10 | t0 | 10 |
| 11～20 | t1 | 10 |
| ⋮ | ⋮ | |

Fig.7

IMAGE PROCESSING APPARATUS AND IMAGE PROCESSING METHOD

CROSS-REFERENCE TO RELATED APPLICATION

This application is based upon and claims the benefit of priority from the prior Japanese Patent Application No. 2014-181502, filed on Sep. 5, 2014, the entire contents of which are incorporated herein by reference.

FIELD

Embodiments described herein, generally, relate to an image processing apparatus and an image processing method.

BACKGROUND

Conventionally, image forming apparatuses each forming an image on a sheet-like recording medium such as a paper sheet by using recording agents including a decolorable coloring material have been developed. For example, such an image forming apparatus is a multifunctional device such as a multifunctional peripheral (MFP). A recording agent (hereinafter, referred to as a decolorable recording agent) including a decolorable coloring material can be decolored by being heated to a predetermined temperature (hereinafter, referred to as a decoloring temperature). In addition, decoloring devices each decoloring an image formed on a recording medium by the image forming apparatus described above have been developed. A conventional decoloring device executes a decoloring process constantly at a decoloring temperature of a same value, and accordingly, there are cases where the power consumption increases.

BRIEF DESCRIPTION OF THE DRAWINGS

FIG. 7 is a diagram that illustrates a specific example of a decoloring temperature information table of an image processing apparatus according to an embodiment;

DETAILED DESCRIPTION

According to one embodiment, an image processing apparatus includes: an image processing unit; a decoloring unit;

and a control unit. The image processing unit acquires information of a printing rate that represents a ratio of an image printed on a sheet from the sheet. The decoloring unit decolors the image by heating the image printed on the sheet at a decoloring temperature. The control unit determines a decoloring temperature used for a decoloring process executed by the decoloring unit based on the acquired information of the printing rate.

Figure 1:
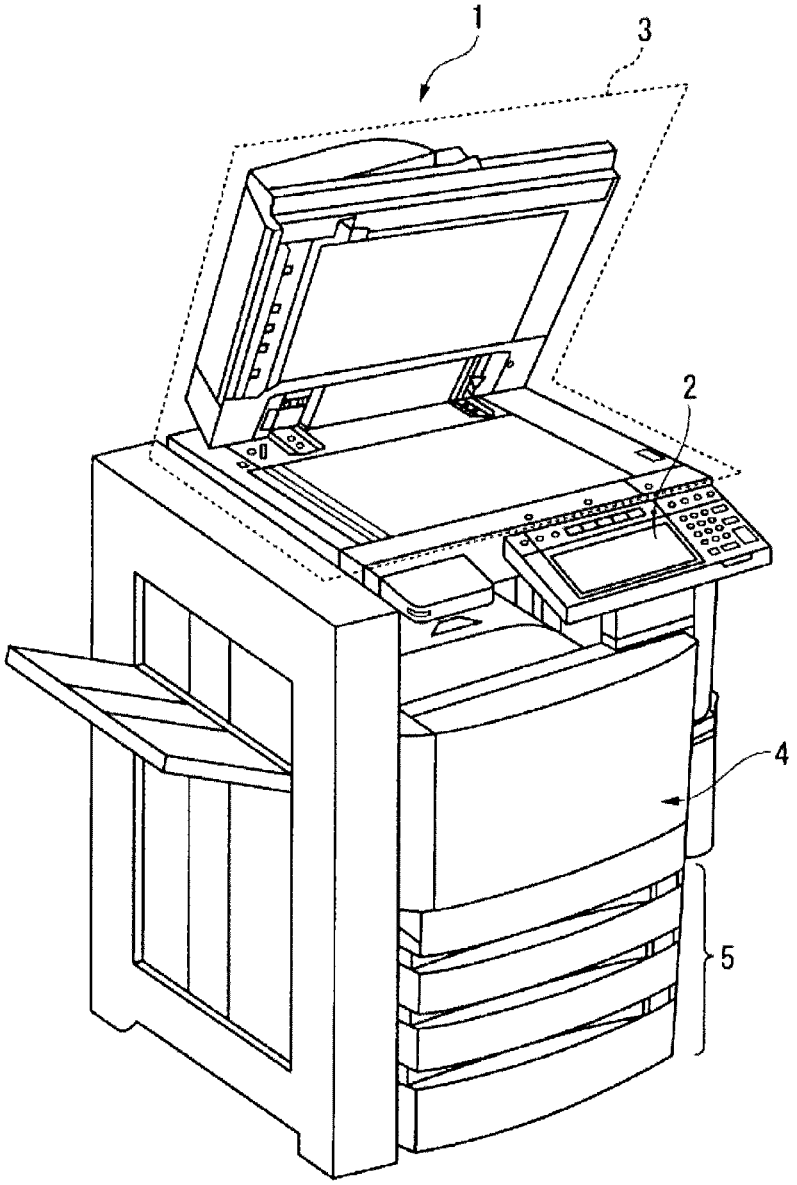
FIG. 1 is an external view that illustrates an example of an image processing apparatus according to an embodiment.

Hereinafter, an embodiment will be described with reference to the drawings. The same reference numerals in the drawings denote the same or similar elements. FIG. 1 is an external view that illustrates an example of an image processing apparatus 1 according to an embodiment. The image processing apparatus 1, for example, is a multifunctional device. The image processing apparatus 1 reads an image of a sheet and generates image data. The image processing apparatus 1 prints the generated image data on a printing sheet by using a decolorable recording agent. Here, the decolorable recording agent is a recording agent that includes a decolorable coloring material. The decolorable recording agent is decolored by being heated at a predetermined decoloring temperature to be described later. The decolorable recording agent, for example, is decolorable toner, decolorable ink, or decolorable ink ribbon. In this embodiment, as the decolorable recording agent, decolorable toner is used. A sheet, for example, is a sheet or a film. The "decoloring" represents reduction of visibility of an image by changing the color of the image formed using a decolorable recording agent. A decolored sheet can be used again. For example, a sheet for which a decoloring process has been executed can be used again as a sheet used for forming an image by the image processing apparatus 1.

The image processing apparatus 1 may print the image data generated as described above on a printing sheet by using a non-decolorable recording agent. The non-decolorable recording agent is a recording agent that includes a non-decolorable coloring material. The non-decolorable recording agent, for example, is ordinary non-decolorable toner. In addition, the image processing apparatus 1 heats an image printed on a sheet by using the decolorable recording agent at the decoloring temperature, thereby decoloring the image. In description presented below, printing of an image based on image data will be referred to as a printing process. Furthermore, the decoloring of an image will be referred to as a decoloring process. The image processing apparatus 1 executes a printing process or a decoloring process according to a user's instruction that has been received. In the case of the printing process, in addition to an original image to be printed, the image processing apparatus 1 prints a printing rate on the sheet. The printing rate is calculated based on the image data. The image processing apparatus 1 forms a printing rate as a mark and prints the printing rate on the sheet as the mark. Here, the printing rate represents a ratio of an image formed on a sheet. For example, the printing rate is a ratio of an area to which toner is attached on the sheet to the area of the sheet. As another example, the printing rate is a ratio of characters, which are formed on a sheet, occupying an area of the sheet to the area of the sheet.

The formation as a mark represents a process of converting a printing rate into code information. The code information, for example, is a one-dimensional barcode or a two-dimensional barcode. In description presented below, the printing rate converted into code information may be referred to as a printed mark. In the case of the decoloring process, the image processing apparatus 1 determines the decoloring temperature based on the printing rate included in a printed mark that is printed on a sheet. The image processing apparatus 1 heats the image formed on the sheet at the determined decoloring temperature, thereby decoloring the image.

As illustrated in FIG. 1, the image processing apparatus 1, for example, includes: an operation panel 2; a scanner unit 3; a printer unit 4; and a sheet feeding unit 5. The operation panel 2 includes a display device and an input device for serving as a user interface. The display device, for example, includes a liquid crystal display or an organic electroluminescence (EL) display. The input device includes a keyboard, a touch panel, or the like. The operation panel 2 receives a user's instruction relating to the process of image processing apparatus 1 through the input device. For example, the instruction includes information representing whether the process to be executed by the image processing apparatus 1 is a printing process or a decoloring process, and the like. In a case where the process executed by the image processing apparatus 1 is the printing process, the instruction includes information representing whether the printing process is a color printing process or a monochrome printing process. In addition, in a case where the process to be executed by the image processing apparatus 1 is the printing process, the instruction includes information representing whether a used toner is decolorable toner or non-decolorable toner.

According to an instruction from the user, in order to execute the printing process or the decoloring process, the scanner unit 3 reads an image formed on a sheet, thereby generating image data. For example, in the case of the printing process, the user sets an original sheet, on which an image has been printed, that is an original for the printing process on the scanner unit 3. On the other hand, for example, in the case of the decoloring process, the user sets a sheet, on which an image has been printed using decolorable toner, that is a target for the decoloring process on the scanner unit 3. The scanner unit 3, for example, includes: an auto document feeder (ADF); a document stand; and a scanner. The ADF automatically conveys a sheet set by the user to an image reading position of the scanner and automatically discharges the sheet after the image reading process. The ADF, for example, is installed to an upper part of the image processing apparatus 1 main body to be freely opened or closed, and covers the document stand and is operable in the closed state. The document stand supports the sheet set by the user for image reading using the scanner. The document stand, for example, is installed to the upper part of the image processing apparatus 1 main body. The scanner reads an image of a sheet conveyed by the ADF at the image reading position. In addition, the scanner reads an image of the sheet supported by the document stand. The scanner, for example, is a color scanner that includes contact image sensors (CIS), charge coupled devices (CCD), or the like. The scanner reads an image of a sheet by using sensors, thereby generating the image data. The printer unit 4 executes a printing process or a decoloring process in accordance with an instruction from the user. The printer unit 4 includes an image forming unit that forms an image on a sheet, for example, by using an electrophotographic method. The image forming unit houses the decolorable toner and non-decolorable toner and, in the case of the printing process, forms an original image to be printed on a printing sheet by using any of the decolorable toner and the non-decolorable toner. In the case of the printing process, in addition to the original image to be printed, the image forming unit forms a first printing mark to be described later on the printing sheet by using the decolorable toner. Further, in the case of the decoloring process, the image forming unit forms a second printing mark to be described later on a sheet that is a target for the decoloring process by using the non-decolorable toner. In addition, the printer unit 4 includes a heating unit. In the case of the printing process, the heating unit heats the original image to be printed and the first printing mark to be described later at a predetermined fixing temperature, thereby serving as a fixing unit used for fixing the image and the mark on a printing sheet. As the original image to be printed and the first printing mark to be described later are fixed on the printing sheet by the fixing unit, the printing process is completed. In addition, in the case of the decoloring process, the heating unit heats the second printing mark to be described later so as to be fixed to the sheet that is a target for the decoloring process and serves as a decoloring unit that heats an image printed on the sheet that is the target for the decoloring process for decoloration. In the heating unit, the heating temperature in the case of the decoloring process is a decoloring temperature to be described later. The fixing temperature of the decolorable toner is lower than the decoloring temperature. In contrast to this, the non-decolorable toner is not decolored even when being heated, and accordingly, the fixing temperature of the non-decolorable toner may be the decoloring temperature. According to the configuration described above, for example, in a case where the operation panel 2 receives a user's instruction for executing the printing process using the decolorable toner, the printer unit 4 prints an original image to be printed on a printing sheet by using the decolorable toner based on the image data and prints the first printing mark to be described later. For example, in a case where the operation panel 2 receives a user's instruction for executing the decoloring process, the printer unit 4 decolors the image of the decolorable toner, which is formed on the sheet that is a target for the decoloring process, and prints the second printing mark to be described later by using the non-decolorable toner. For the printing process, the sheet feeding unit 5 houses printing sheets and supplies the printing sheets to the printer unit 4. In addition, for the decoloring process, the sheet feeding unit 5 houses sheets that are targets for the decoloring process and supplies the sheets that are the targets for the decoloring process to the printer unit 4. The sheet feeding unit 5, for example, includes a plurality of sheet feed cassettes used for housing sheets. The sheet feed cassettes, for example, are installed to be able to be drawn from the image processing apparatus 1 main body. For example, in the case of the printing process, the user sets printing sheets in the sheet feed cassettes in advance. In the case of the decoloring process, the user sets sheets that are targets for the decoloring process to the sheet feed cassettes in advance. More specifically, as will be described later, sheets that are targets for the decoloring process, before being set in the sheet feed cassette, are set in the scanner unit 3 once, and printing marks (see FIGS. 3 to 6) to be described later are read by the scanner unit 3. The user sets the sheets that are targets for the decoloring process in the sheet feed cassettes according to the order in which the printing mark is read. For example, in a case where the sheet feeding unit 5 sequentially feeds sheets housed in the sheet feeding cassettes from the top, the user sets sheets, which are targets for the decoloring process, in the sheet feeding cassette such that a sheet, of which the printing mark has been read first, that is a target for the decoloring process is disposed on a further upper side. The sheet feeding cassette in which printing sheets are housed and the sheet feeding cassette in which sheets that are targets for the decoloring process are housed may be the same sheet feed cassette or may be sheet feed cassettes different from each other. The user can select the sheet feed cassette in which printing sheets are housed or the sheet feed cassette in which sheets that are targets for the decoloring process are housed through the operation panel 2.

Figure 2:
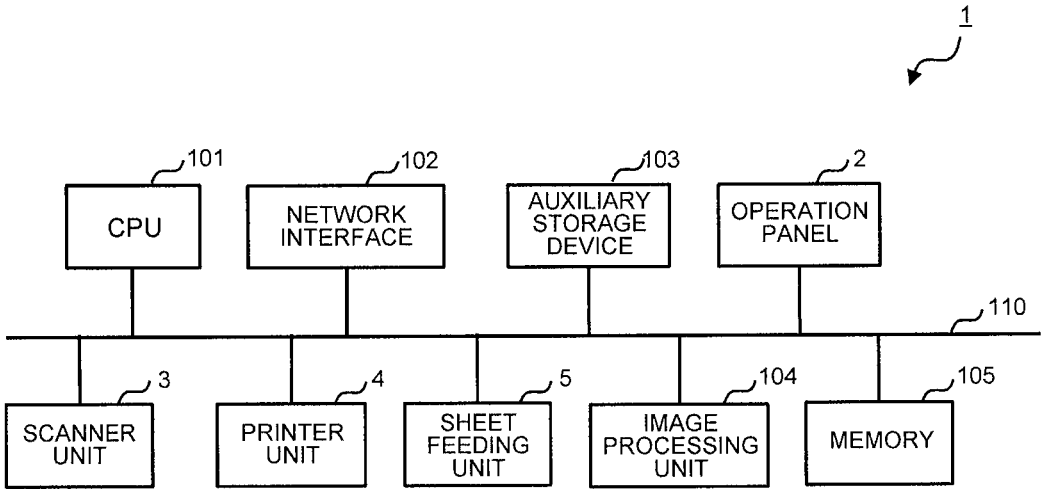
FIG. 2 is a block diagram that illustrates the hardware configuration of an image processing apparatus according to an embodiment.

FIG. 2 is a block diagram that illustrates the hardware configuration of the image processing apparatus 1. In addition to the units 3 to 5 described above, the image processing apparatus 1 includes: a central processing unit (CPU) 101 that is a control unit; a network interface 102; an auxiliary storage device 103; an image processing unit 104; and a memory 105. As illustrated in FIG. 2, the constituent elements 3 to 5 and 101 to 105 of the image processing apparatus 1 are interconnected through an internal bus 110 and can input/output data thereof.

The CPU 101 controls the overall operation of the image processing apparatus 1 including the constituent elements 3 to 5 and 102 to 105. For example, in the case of the decoloring process, the CPU 101 determines the decoloring temperature based on the value of the printing rate that is acquired by the image processing unit 104. In description presented below, the value of the printing rate will be simply referred to as a printing rate. The CPU 101 causes the printer unit 4 to execute the decoloring process at the determined decoloring temperature by controlling the printer unit 4. The network interface 102 transmits/receives data to/from an external device. The network interface 102 operates as an input interface and receives data transmitted from an external device. In addition, the network interface 102 operates as an output interface and transmits data to an external device. For example, the image processing apparatus 1 may acquire image data from an external device through the network interface 102 and print an image based on the acquired image data on a printing sheet.

The auxiliary storage device 103 is a storage medium such as a hard disk or a solid state drive (SSD) and stores various kinds of data. In addition, the auxiliary storage device 103, for example, stores image data generated by the scanner unit 3. Furthermore, the auxiliary storage device 103 stores a decoloring temperature information table. The decoloring temperature information table includes records each including information relating to a decoloring temperature used for the decoloring process. Hereinafter, each of the records will be referred to as a decoloring temperature information record. The auxiliary storage device 103 stores a decoloring temperature information table for each number of times of execution of the decoloring process. More specifically, the auxiliary storage device 103 stores a decoloring temperature information table for a case where the number of times of execution of the decoloring process is one, . . . , a decoloring temperature information table for a case where the number of times of execution of the decoloring process is n (here, n is an integer or two or more). The decoloring temperature information table will be described later in detail.

The image processing unit 104 acquires the image data generated by the scanner unit 3. In a case where the operation panel 2 receives a user's instruction for the printing process, the image processing unit 104 calculates a printing rate based on the image data. The image processing unit 104 forms a mark representing the calculated printing rate, thereby generating the printing mark (for example, see the printing mark 24 illustrated in FIG. 3) to be described later. The image processing unit 104 combines the generated printing mark 24 with the image data. More specifically, the image processing unit 104 combines the printing mark with the image data such that the printing mark is printed in a first detection target area 23 (for example, see FIG. 3), which will be described later, of the printing sheet. Hereinafter, the printing mark printed in the first detection target area 23 to be described later will be referred to as a first printing mark. In addition, the printing rate included in the first printing mark through the formation of the mark will be referred to as a first printing rate. In other words, this first printing rate is a printing rate calculated based on the image data by the image processing unit 104 in the printing process. The printer unit 4 prints an original image to be printed together with the first printing mark on a printing sheet based on the image data in which the first printing mark including the first printing rate is combined.

In a case where the operation panel 2 receives a user's instruction for the decoloring process, the image processing unit 104 detects a printing mark included in the image data generated by the scanner unit 3. More specifically, the image processing unit 104 detects the first printing mark 24 printed in the first detection target area 23 of the sheet that is a target for the decoloring process. The image processing unit 104 acquires a first printing rate included in the detected first printing mark 24. The image processing unit 104 calculates a new printing rate including the acquired first printing rate. Hereinafter, the new printing rate calculated in the decoloring process will be referred to as a second printing rate. This second printing rate will be described later in detail. The image processing unit 104 outputs the second printing rate to the CPU 101. After the output of the second printing rate, the image processing unit 104 forms a mark representing the second printing rate, thereby generating the printing mark. Hereinafter, the printing mark formed as a mark representing the second printing rate will be referred to as a second printing mark. In other words, the second printing mark is a printing mark that includes the second printing rate. The image processing unit 104 generates image data of the second printing mark such that the second printing mark is printed in a second detection target area 25, which will be described later, of a sheet that is a target for the decoloring process. The second detection target area 25 is an area other than the first detection target area 23.

Every time when the operation panel 2 receives a user's instruction for the decoloring process, the image processing unit 104, in order to print the second printing mark within the second detection target area, generates image data of the second printing mark. In a case where there is the second printing mark that has already been printed in the second detection target area 25, which will be described later, of the sheet that is a target for the decoloring process, the image processing unit 104 generates image data of the second printing mark, for example, printed at a position shifted downward by a predetermined amount from a position of the second printing mark, which has been printed last, in the second detection target area 25 of the sheet that is the target for the decoloring process. For example, in a case where there is one second printing mark in the second detection target area 25, the second printing mark is the second printing mark that has been printed last. On the other hand, for example, in a case where there are two second printing marks in the second detection target area, the second printing mark that has been printed second is the second printing mark that has been printed last. The image processing unit 104 generates image data of the second printing mark for printing a new second printing mark at a position shifted downward by a predetermined amount from the position of the latest second printing mark in the second detection target area 25 every time when the decoloring process is executed. The printer unit 4, based on the image data of this second printing mark, prints the new second printing mark in the second detection target area 25 of the sheet that is the target for the decoloring process. Accordingly, the second printing mark that is located at a lowermost position among the second printing marks that are present in the second detection target area 25 is the latest second printing mark. The memory 105, for example includes a random access memory (RAM). The memory 105 temporarily stores data that is used by each constituent element of the image processing apparatus 1 in the printing process or the decoloring process. The memory 105, for example, may be configured to temporarily store the image data that is generated by the scanner unit 3.

Figure 3:
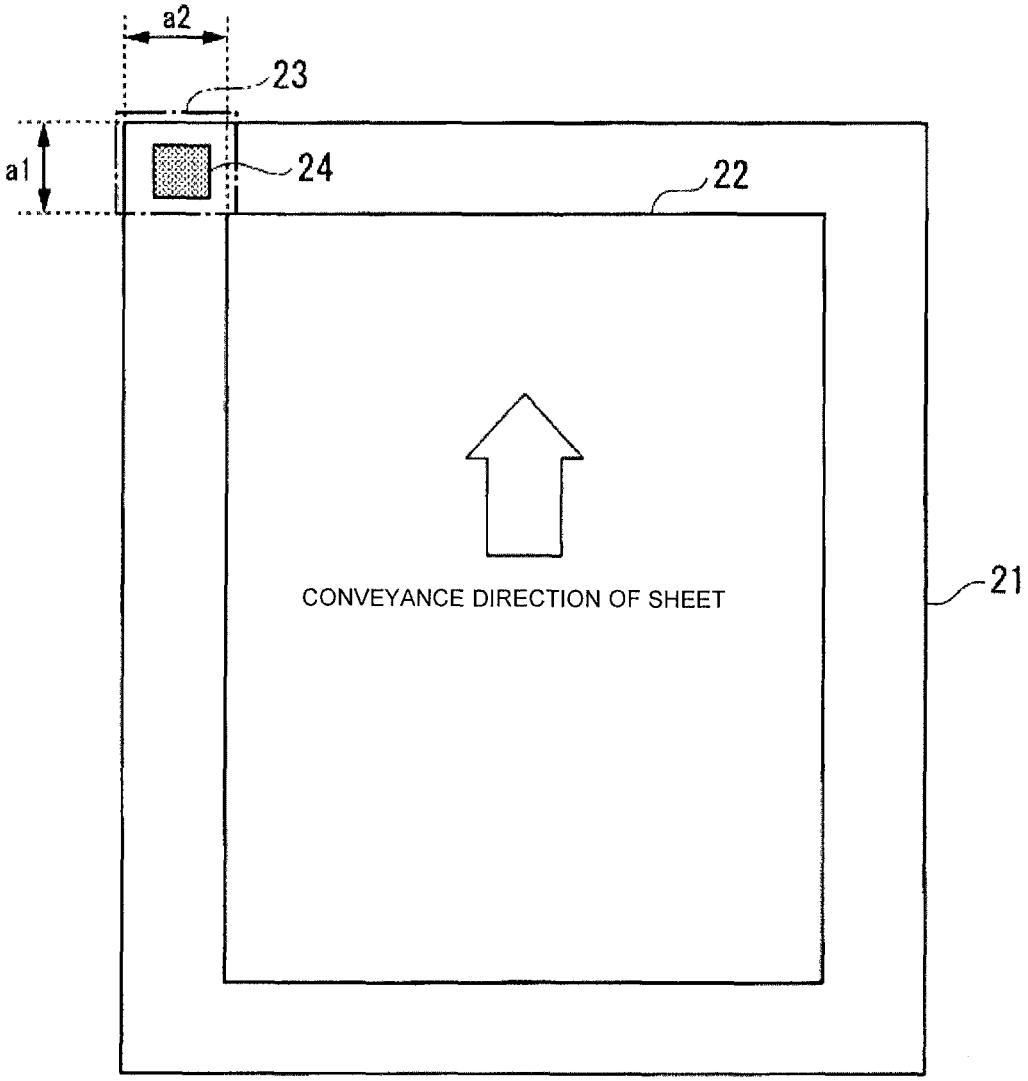
FIG. 3 is a diagram that illustrates a specific example of a sheet after a first printing process is executed by an image processing apparatus according to an embodiment.

Hereinafter, changes in the state of one sheet in a case where the printing process using the decolorable toner and the decoloring process are repeatedly executed for the one sheet will be described more specifically with reference to FIGS. 3 to 6. FIG. 3 is a diagram that illustrates a specific example of a sheet after a first printing process is executed. The sheet 21 includes an image formation area 22. The image formation area 22 is a range in which an original image to be printed using the decolorable toner is printed. In a case where a user's instruction for executing the first printing process is received through the operation panel 2, the image processing apparatus 1 prints an image in the image formation area 22. The image processing apparatus 1 can form an image also on the outside of the image formation area 22. For example, the image processing apparatus 1 may be configured to print an image relating to a header and a footer outside the image formation area 22.

The sheet 21 additionally includes a first detection target area 23. The first detection target area 23 is arranged outside the image formation area 22. The first detection target area 23 is a range in which the first printing mark 24 is printed. As illustrated in FIG. 3, in the first detection target area 23 of the sheet 21 after the first printing process is executed, the first printing mark 24 at the time of executing the first printing process is printed. One first detection target area 23, as illustrated in FIG. 3, is defined as an area surrounded by a front end side, a left side, a first inner side, and a second inner side. The front end side is a side disposed at the front end in the conveyance direction of the sheet. The left side is a side disposed at the left end in the conveyance direction of the sheet. The first inner side is a side that is positioned to be separate from the front end side by a length a1 and is parallel to the front end side. The second inner side is a side that is positioned to be separate from the left side by a length a2 in the conveyance direction of the sheet and is parallel to the left side.

The first printing mark 24 illustrated in FIG. 3 includes the first printing rate calculated by the image processing unit 104 in a case where the operation panel 2 receives a user's instruction for executing the first printing process. The first printing mark 24 is printed using the decolorable toner. Accordingly, when the decoloring process is executed by the image processing apparatus 1, the image printed in the image formation area 22 and the first printing mark 24 printed in the first detection target area 23 are decolored as illustrated in FIG. 4.

Figure 4:
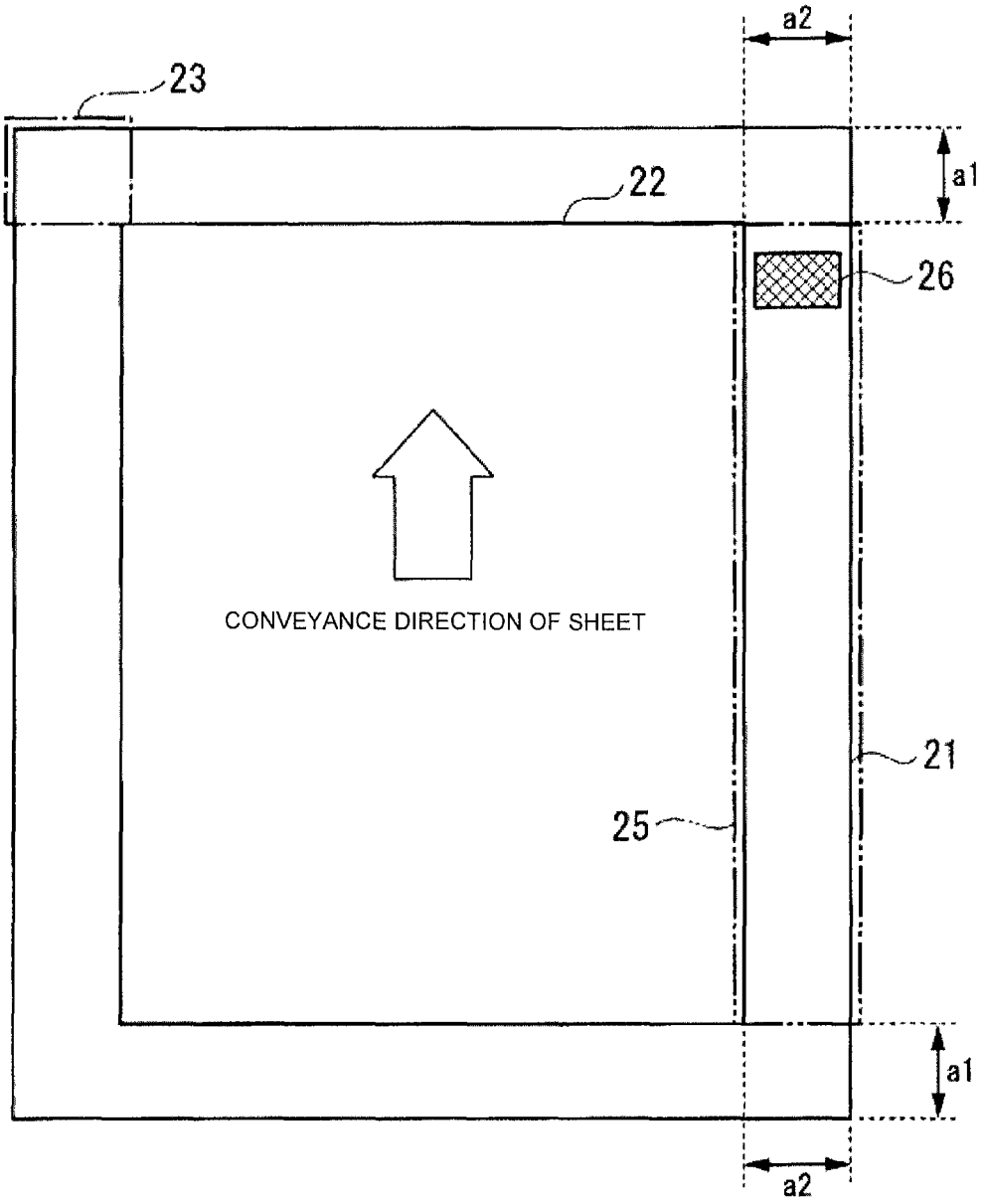
FIG. 4 is a diagram that illustrates a specific example of a sheet after a first decoloring process is executed by an image processing apparatus according to an embodiment.

FIG. 4 is a diagram that illustrates a specific example of the sheet 21 after the first decoloring process is executed for the sheet 21 illustrated in FIG. 3. The sheet 21 includes a second detection target area 25 other than the first detection target area 23. The second detection target area 25 is arranged at a position different from the position of the first detection target area 23 outside the image formation area 22. The second detection target area 25 is a range in which the second printing mark is printed. As illustrated in FIG. 4, in the second detection target area 25 of the sheet 21 after the execution of the first decoloring process, the second printing mark 26 at the time of executing the first decoloring process is printed. The second detection target area 25, as illustrated in FIG. 4, is defined as an area acquired by excluding a second area and a third area from a predetermined first area. The first area is an area that is surrounded by a right side, a third inner side, a rear end side, and the front end side. The right side is a side disposed at the right end in the conveyance direction of the sheet. The third inner side is a side that is positioned to be separate from the right side by a length a2 and is parallel to the right side. The rear end side is a side that is disposed at the rear end in the conveyance direction of the sheet and is parallel to the front end side. The second area is an area that is surrounded by the front end side, a fourth inner side, the right side, and a fifth inner side. The fourth inner side is positioned to be separate from the front end side by a length a1 and is parallel to the front end side. The fifth inner side is a side that is positioned to be separate from the right side in the conveyance direction of the sheet by a length a2 and is parallel to the right side. The third area is an area that is surrounded by the rear end side, a sixth inner side, a seventh inner side, and the right side. The sixth inner side is a side that is positioned to be separate from the rear end side by a length a1 and is parallel to the rear end side. The seventh inner side is a side that is positioned to be separate from the right side by a length a2 and is parallel to the right side.

The second printing mark 26 at the time of executing the first decoloring process, as described above, includes the second printing rate calculated by the image processing unit 104 in a case where the operation panel 2 receives a user's instruction for executing the first decoloring process. The second printing rate includes the first printing rate acquired from the first printing mark 24 (see FIG. 3) printed in the first detection target area 23 before the first decoloring process. The second printing mark 26 is printed using non-decolorable toner. Accordingly, the second printing mark 26 is not decolored even when the decoloring process is executed by the image processing apparatus 1. In a case where the image processing apparatus 1 receives a user's instruction for executing the first decoloring process through the operation panel 2, an image printed in the image formation area 22 and the first printing mark 24 that is present in the first detection target area 23 is decolored. In addition, through the first decoloring process, as described above, the second printing mark 26 is printed in the second detection target area 25.

Figure 5:
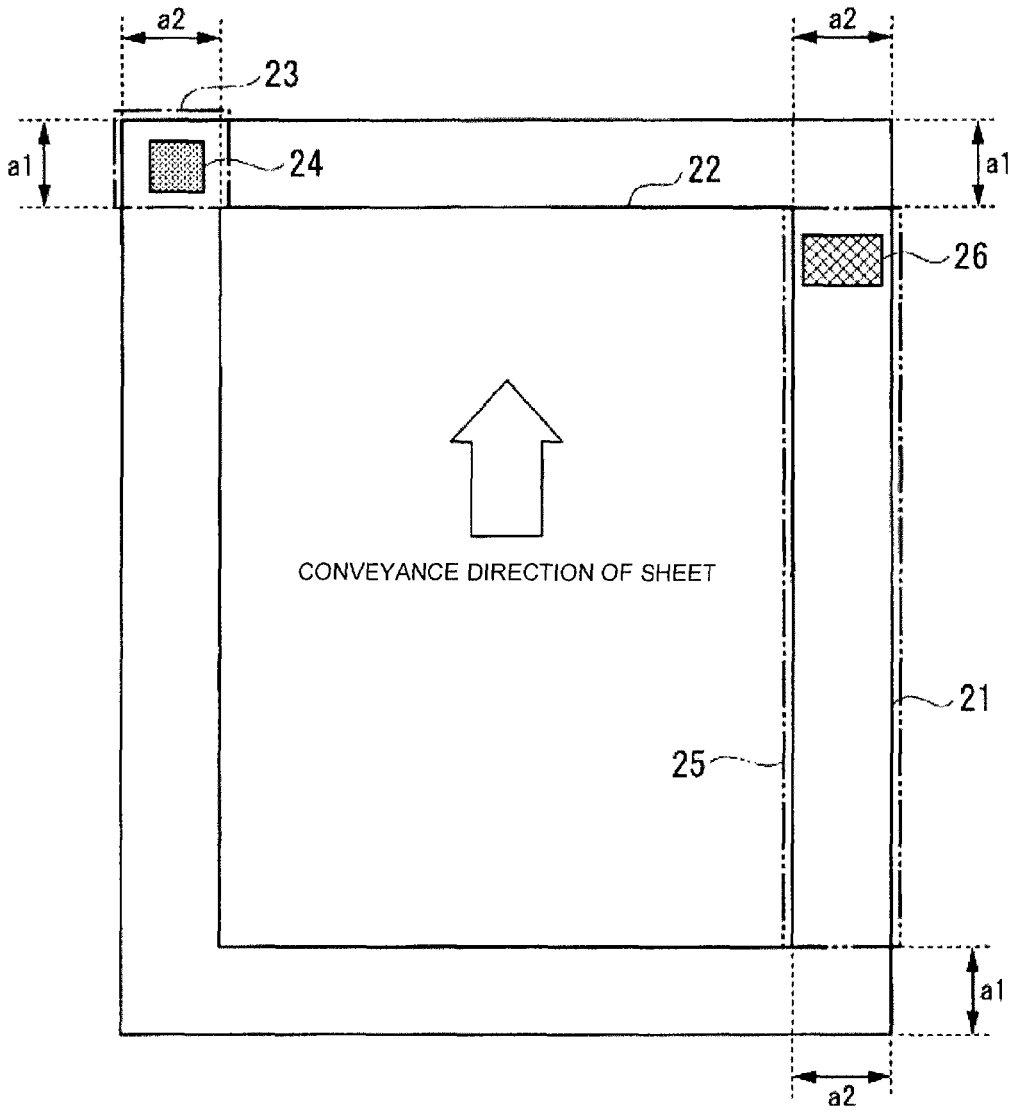
FIG. 5 is a diagram that illustrates a specific example of a sheet after a second printing process is executed by an image processing apparatus according to an embodiment.

FIG. 5 is a diagram that illustrates a specific example of the sheet after a second printing process is executed for the sheet 21 illustrated in FIG. 4. As illustrated in FIG. 5, in the first detection target area 23 of the sheet 21 after the execution of the second printing process, the first printing mark 24 at the time of executing the second printing process is printed. The first printing mark 24 illustrated in FIG. 5 includes the first printing rate calculated by the image processing unit 104 in a case where the operation panel 2 receives a user's instruction for executing the second printing process. In addition, in the second detection target area 25, the second printing mark 26 printed at the time of executing the first decoloring process is present. Accordingly, as illustrated in FIG. 5, the sheet after the second printing process is in a state in which a plurality of printing marks (the printing mark 24 and the printing mark 26) are printed.

Figure 6:
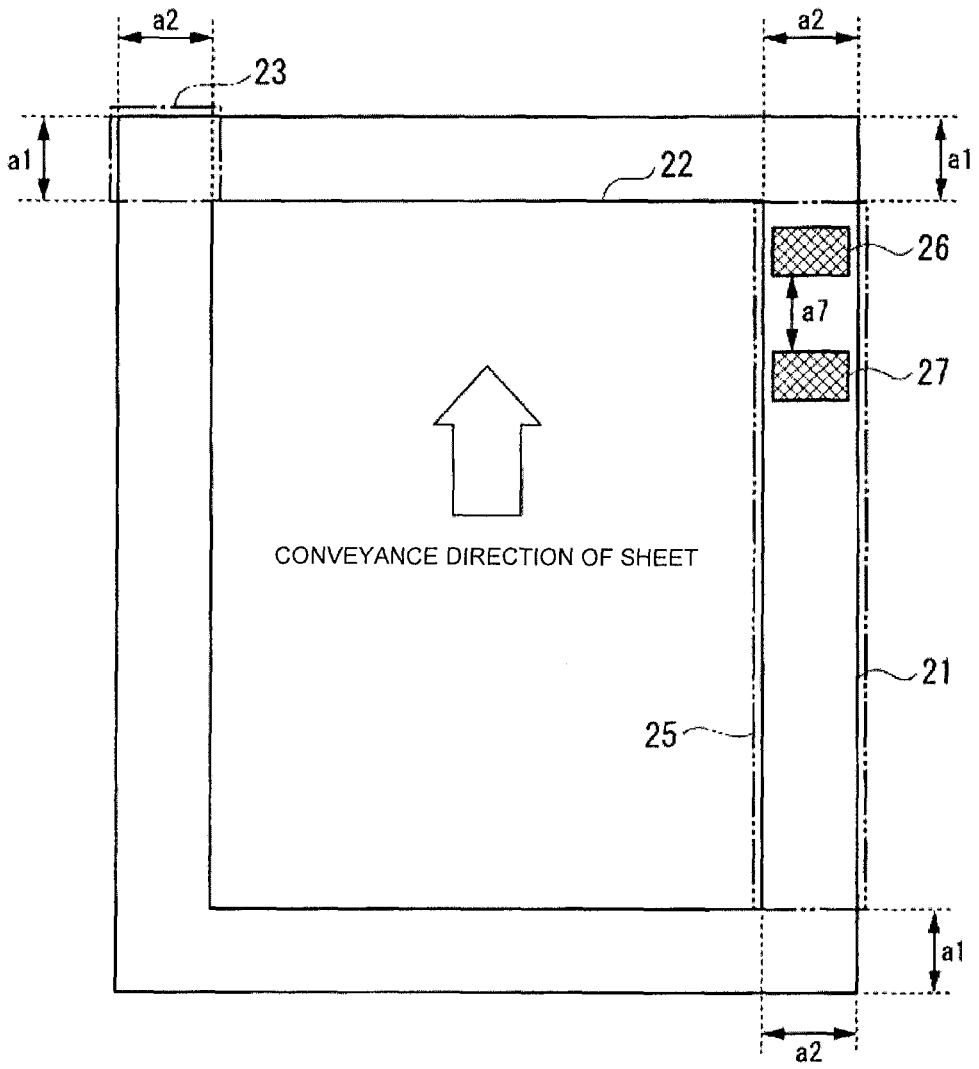
FIG. 6 is a diagram that illustrates a specific example of a sheet after a second decoloring process is executed by an image processing apparatus according to an embodiment.

FIG. 6 is a diagram that illustrates a specific example of a sheet after a second decoloring process is executed for the sheet 21 illustrated in FIG. 5. In the example illustrated in FIG. 6, the image printed in the image formation area 22 and the first printing mark 24 disposed in the first detection target area 23 are decolored. In addition, in the second detection target area 25, the second printing mark 27 at the time of executing the second decoloring process is newly printed. The second printing mark 27 is printed at a position shifted downward by a predetermined amount a7 from the position of the second printing mark 26. The second printing mark 27 at the time of executing the second decoloring process includes the second printing rate calculated by the image processing unit 104. The second printing rate at the time of executing the second decoloring process includes the first printing rate acquired from the first printing mark 24 (see FIG. 5) printed in the first detection target area 23 before the second decoloring process (after the second printing process). In addition, the second printing rate at the time of executing the second decoloring process includes the second printing rate acquired from the second printing mark 26 printed in the second detection target area 25 at the time of executing the first decoloring process. More specifically, the second printing rate included in the second printing mark 27 at the time of executing the second decoloring process is calculated by adding the first printing rate acquired from the first printing mark 24 printed in the first detection target area 23 before the second decoloring process and the second printing rate acquired from the second printing mark 26 printed in the second detection target area 25 at the time of executing the first decoloring process. In other words, the second printing rate included in the second printing mark at the time of executing the decoloring process (for example, the "n"-th decoloring process) is calculated by adding the first printing rate acquired from the first printing mark 24 printed in the first detection target area 23 before the decoloring process and the second printing rate acquired from the second printing mark printed within the second detection target area at the time of executing the previous decoloring process (at the time of executing the "n-1"-th decoloring process), in other words, the latest second printing mark. In addition, the second printing rate included in the second printing mark 26 at the time of executing the first decoloring process described above, more specifically, is calculated by adding the first printing rate acquired from the first printing mark 24 printed in the first detection target area 23 before the decoloring process and the second printing rate acquired from the latest second printing mark. However, on the sheet 21 before the first decoloring process, the second printing mark is not printed. Accordingly, the second printing rate included in the second printing mark 26 at the time of executing the first decoloring process is calculated, for example, by setting the second printing rate acquired from the latest second printing mark to zero. On the sheet 21 illustrated in FIG. 6, the second printing mark 27 is the latest second printing mark.

As illustrated in FIGS. 3 to 6 described above, every time when the decoloring process is executed, the image printed in the image formation area 22 and the first printing mark 24 disposed in the first detection target area 23 are decolored. In addition, every time when the decoloring process is executed, the second printing mark is printed in the second detection target area 25. Accordingly, the number of the second printing marks disposed in the second detection target area 25 represents the number of times of execution of the decoloring process. Every time when the decoloring process is executed, the image processing unit 104 calculates a new second printing rate by adding the first printing rate acquired from the first printing mark 24 and the second printing rate acquired from the latest second printing mark. In a case where the second printing rate exceeds 100, the second printing rate is set to 100. The image processing unit 104, in order to print the new second printing mark including the second printing rate calculated as described above in the second detection target area 25, generates image data of the second printing mark. Furthermore, the image processing unit 104 outputs the second printing rate calculated as described above to the CPU 101. The CPU 101 can acquire an index that is a reference for determining the decoloring temperature used for the decoloring process. The CPU 101 determines a decoloring temperature used for the decoloring process based on the second printing rate that has been output as described above and the decoloring temperature information table. Then, the printer unit 4 heats the image of the sheet that is a target for the decoloring process at the determined decoloring temperature, thereby executing the decoloring process.

Hereinafter, the decoloring temperature information table will be described with reference to FIG. 7. FIG. 7 is a diagram that illustrates a specific example of the decoloring temperature information table. In the decoloring temperature information table, a printing rate and a decoloring temperature are registered in association with each other, and the decoloring temperature information table is stored in the auxiliary storage device 103. More specifically, as illustrated in FIG. 7, the decoloring temperature information table has a plurality of decoloring temperature information records 10. The decoloring temperature information record 10 includes values of a printing rate and a decoloring temperature. The printing rate included in the decoloring temperature information record 10 corresponds to the second printing rate. The printing rate, as described above, represents the ratio of an image formed on a sheet. The printing rate, as illustrated in FIG. 7, is a predetermined range. A decoloring temperature included in the decoloring temperature information record 10 having a printing rate (range) in which the second printing rate is included represents the decoloring temperature used for the decoloring process by the image processing apparatus 1.

In the example illustrated in FIG. 7, in the decoloring temperature information table, a plurality of printing rates are registered, and decoloring temperatures corresponding to the printing rates are registered. The printing rates illustrated in FIG. 7 are "0 to 10", "11 to 20", and " . . . ". In correspondence with such printing rates, the decoloring temperatures are "t0", "t1", and " . . . ". For example, the decoloring temperature information record 10 registered at the uppermost end of the decoloring temperature information table has a printing rate of "0 to 10" and a decoloring temperature of "t0". In a case where the second printing rate output to the CPU 101 by the image processing unit 104 is "0 to 10", the CPU 101 determines the decoloring temperature used for the decoloring process by referring to the decoloring temperature information record 10 registered at the uppermost end of the decoloring temperature information table. In the decoloring temperature information table, the lower the printing rate is a lower decoloring temperature, which is lower than that of a case of a higher printing rate, is registered.

Figure 8:
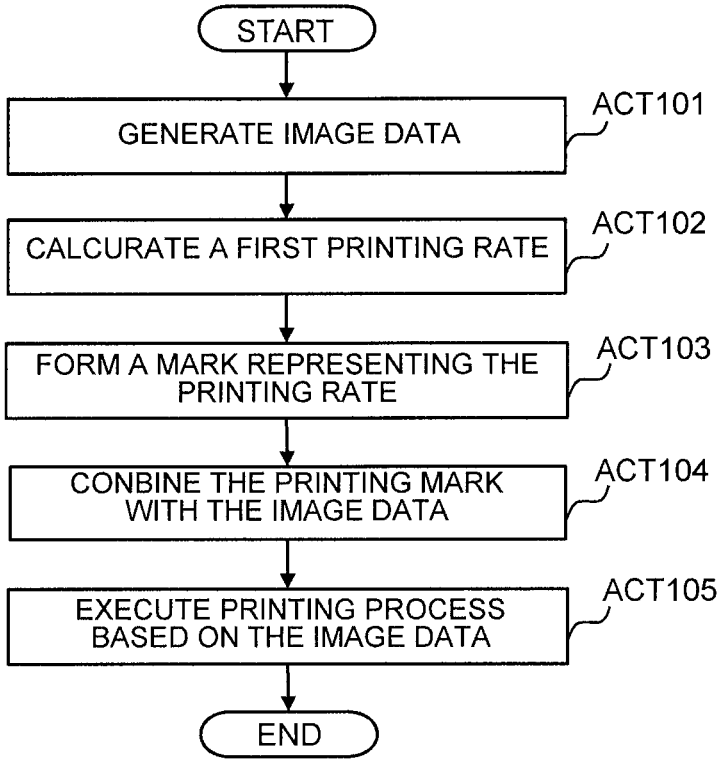
FIG. 8 is a flowchart that illustrates a printing process executed by an image processing apparatus according to an embodiment.

Hereinafter, the printing process using the decolorable toner that is executed by the image processing apparatus 1 will be described with reference to FIG. 8. FIG. 8 is a flowchart that illustrates the flow of the printing process of image data that is executed by the image processing apparatus 1. In the case of the printing process, the user sets an original sheet in the ADF or the document stand of the scanner unit 3 in advance. As illustrated in FIG. 8, in ACT101 (generation of image data), when the operation panel 2 receives a user' instruction for executing the printing process, the scanner unit 3 reads an image from the set original sheet, thereby generating image data. When the scanner unit 3 generates the image data, the process of the image processing apparatus 1 proceeds to ACT102. In ACT102 (calculation of the first printing rate), the image processing unit 104 calculates a first printing rate based on the image data generated by the scanner unit 3. When the first printing rate is calculated by the image processing unit 104, the process of the image processing apparatus 1 proceeds to ACT103. In ACT103 (formation of a mark representing the printing rate), the image processing unit 104 forms a mark representing the calculated printing rate, thereby generating the first printing mark 24. When the first printing mark 24 is generated by the image processing unit 104, the process of the image processing apparatus 1 proceeds to ACT104. In ACT104 (combination of the printing mark with the image data), the image processing unit 104, in order to print the generated first printing mark 24 in the first detection target area 23 of the printing sheet, combines the first printing mark 24 with the image data generated by the scanner unit 3. When the image processing unit 104 combines the first printing mark 24 with the image data, the process of the image processing apparatus 1 proceeds to ACT105. In ACT105 (execution of the printing process based on the image data), based on the image data combined by the first printing mark 24, the printer unit 4, by using the decolorable toner, prints the first printing mark 24 in the first detection target area 23 of a printing sheet and prints the original image to be printed in the image formation area 22 of the printing sheet (see FIG. 3).

Figure 9:
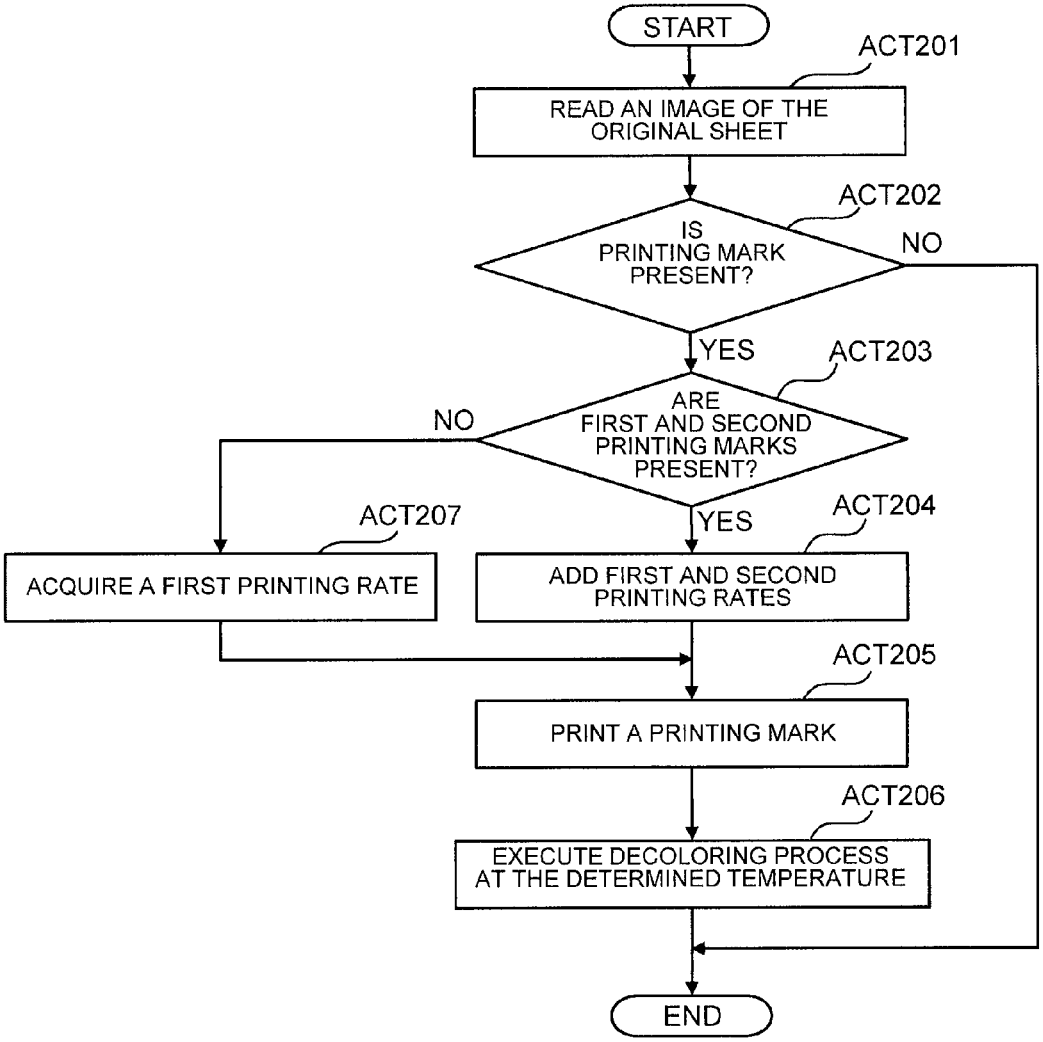
FIG. 9 is a flowchart that illustrates a decoloring process executed by an image processing apparatus according to an embodiment.

Hereinafter, the decoloring process executed by the image processing apparatus 1 will be described with reference to FIG. 9. FIG. 9 is a flowchart that illustrates the flow of the decoloring process executed by the image processing apparatus 1. Also in the case of the decoloring process, the user sets a sheet that is a target for the decoloring process in the ADF or the document stand of the scanner unit 3 once in advance. As illustrated in FIG. 9, in ACT201, when the operation panel 2 receives a user's instruction for executing the decoloring process, the scanner unit 3 reads an image of the set original sheet, thereby generating image data. When the image data is generated by the scanner unit 3, the process of the image processing apparatus 1 proceeds to ACT202. In ACT202, the image processing unit 104 determines whether or not the printing mark is printed on the sheet that is the target for the decoloring process based on the image data generated by the scanner unit 3. More specifically, the image processing unit 104 determines whether or not the printing mark is included in the image data. For example, in a case where a printing mark is printed in any one of the first detection target area 23 and the second detection target area 25 of the sheet that is the target for the decoloring process, the image processing unit 104 determines that the printing mark is included in the image data (Yes in ACT202). On the other hand, in a case where no printing mark is printed in the first detection target area 23 and the second detection target area 25 of the sheet that is the target for the decoloring process, the image processing unit 104 determines that the printing mark is not included in the image data (No in ACT202).

In a case where the image processing unit 104 determines that no printing mark is included in the image data, the image processing apparatus 1 ends the decoloring process according to this embodiment. On the other hand, in a case where the image processing unit 104 determines that the printing mark is included in the image data, the process of the image processing apparatus 1 proceeds to ACT203. In ACT203, the image processing unit 104 determines whether or not the first printing mark and the second printing mark are printed on the sheet that is the target for the decoloring process based on the image data. More specifically, the image processing unit 104 determines whether both the first printing mark and the second printing mark are included in the image data or whether only the first printing mark is included in the image data. In a case where the image processing unit 104 determines that both the first printing mark and the second printing mark are included in the image data (Yes in ACT203), the process of the image processing apparatus 1 proceeds to ACT204. In ACT204, the image processing unit 104 acquires the first printing rate included in the first printing mark. In addition, the image processing unit 104 acquires the second printing rate included in the latest second printing mark. The image processing unit 104 calculates a new second printing rate by adding the first printing rate and the second printing rate acquired as described above. The image processing unit 104 forms a mark representing this new second printing rate and, in order to print the new second printing mark in the second detection target area 25 of the sheet that is the target for the decoloring process, generates image data of the second printing mark. In addition, the image processing unit 104 acquires information of the number of second printing marks printed in the second detection target area 25 of the sheet that is the target for the decoloring process based on the image data (see ACT201) generated by the scanner unit 3. Furthermore, the image processing unit 104 outputs the new second printing rate calculated as described above and the information of the number of second printing marks acquired as described above to the CPU 101. When the image processing unit 104 executes the above-described process such as the calculation of a new second printing rate, the process of the image processing apparatus proceeds to ACT205.

In ACT205, the CPU 101, for example, by controlling the display device of the operation panel 2, displays a message urging the user to set a sheet that is a target for the decoloring process for which the reading process executed by the scanner unit 3 has been completed in the sheet feeding unit 5 on the display device of the operation panel 2. In addition, the CPU 101 detects whether or not the sheet that is a target for the decoloring process, for which the reading process has been completed, is set in the sheet feeding unit 5 by using a sensor not illustrated in the figure. When the sheet that is the target for the decoloring process is determined to be set in the sheet feeding unit 5, the CPU 101 controls the sheet feeding unit 5. The CPU 101, by controlling the sheet feeding unit 5, supplies the sheet that is the target for the decoloring process from the sheet feeding unit 5 to the printer unit 4. The printer unit 4 prints the second printing mark in the second detection target area 25 of the sheet that is the target for the decoloring process by using the non-decolorable toner based on the image data (see ACT204 and ACT207 to be described later) of the second printing mark generated by the image processing unit 104. In addition, in a case where the second printing mark that has already been printed in the second detection target area 25 is present (Yes in ACT203), as described above, the printer unit 4 prints the new second printing mark at a position shifted from the print position of the second printing mark that has already been printed by a predetermined amount. On the other hand, in a case where the second printing mark that has already been printed in the second detection target area 25 is not present (No in ACT203 to be described later), the printer unit 4 prints the second printing mark at a predetermined position in the second detection target area 25. In a case where the printer unit 4 executes the above-described process such as printing the second printing mark and the like, the process of the image processing apparatus 1 proceeds to ACT206. In ACT206, the CPU 101 selects a decoloring temperature information table corresponding to the number (see ACT204) of the second printing marks output by the image processing unit 104 from among a plurality of decoloring temperature information tables stored in the auxiliary storage device 103. The CPU 101 determines a decoloring temperature corresponding to the second printing rate (see ACT204) output by the image processing unit 104 based on the selected decoloring temperature information table.

More specifically, first, the CPU 101 selects one decoloring temperature information table from among the plurality of decoloring temperature information tables stored in the auxiliary storage device 103 based on the number of the second printing marks output by the image processing unit 104. For example, the CPU 101 selects a decoloring temperature information table corresponding to the number of times of execution of the decoloring process by using a value acquired by adding a predetermined number, for example, one to the number of the second printing marks as the number of times of execution of the decoloring process. The CPU 101 reads the selected decoloring temperature information table from the auxiliary storage device 103. The CPU 101 selects the decoloring temperature information record 10 including the second printing rate described above from among a plurality of decoloring temperature information records 10 of the read decoloring temperature information table. The CPU 101 acquires the value of the decoloring temperature included in the selected decoloring temperature information record 10. The CPU 101 determines the acquired decoloring temperature as the decoloring temperature that is used for the decoloring process. The CPU 101 controls the printer unit 4 so as to execute the decoloring process at the determined decoloring temperature. Under the control of the CPU 101, the printer unit 4 executes the decoloring process for the sheet that is the target for the decoloring process at the determined decoloring temperature.

On the other hand, in ACT203, in a case where the image processing unit 104 determines that only the first printing mark is included in the image data (see ACT201) generated by the scanner unit 3 (No in ACT203), the process of the image processing apparatus 1 proceeds to ACT207. In ACT207, the image processing unit 104 acquires the first printing rate from the first printing mark. The image processing unit 104 calculates a second printing rate based on the acquired first printing rate. More specifically, the image processing unit 104 sets the first printing rate as the second printing rate. The image processing unit 104 forms a mark representing this second printing rate and, in order to print the second printing mark in the second detection target area 25 of the sheet that is the target for the decoloring process, generates image data of the second printing mark. In addition, the image processing unit 104 acquires the information of the number of second printing marks printed in the second detection target area 25 of the sheet that is the target for the decoloring process based on the image data (see ACT201) generated by the scanner unit 3. The number of second printing marks of this case is zero. Furthermore, the image processing unit 104 outputs the second printing rate calculated as described above and the information of the number of second printing marks acquired as described above to the CPU 101. When the image processing unit 104 executes the above-described process such as the calculation of the second printing rate and the like, the process of the image processing apparatus proceeds to ACT205 described above.

As described above, in the image processing apparatus 1 according to the embodiment, the decoloring temperature used for the decoloring process is determined based on the printing rate (the second printing rate described above) included in the sheet that is the target for the decoloring process as a printed mark. For example, the image processing apparatus 1 determines the decoloring temperature to be a lower temperature, which is lower than that of the case of a higher printing rate, as the printing rate (the second printing rate described above) is lower. Accordingly, the image processing apparatus 1 can reduce the possibility of constantly executing the decoloring process at a constant decoloring temperature. Thus, the image processing apparatus 1 can execute the decoloring process of an image with the power consumption being suppressed. In addition, every time when the decoloring process is executed, the image processing apparatus 1 prints the value of the printing rate (the second printing rate) that is a reference for determining the decoloring temperature used for the decoloring process on the sheet as a printing mark (the second printing mark). Accordingly, the image processing apparatus 1 prints the printing marks (the second printing marks) corresponding to the number of times of execution of the decoloring process on the sheet. Thus, according to the image processing apparatus 1 of the embodiment, the user can acquire the number of times of execution of the decoloring process for one sheet by only visually recognizing the printing marks printed in a predetermined area (the second detection target area) of the sheet.

The image processing apparatus 1 determines a decoloring temperature used for the decoloring process by using the decoloring temperature information table that is different for each number of times of execution of the decoloring process. The decoloring process, as described above, reduces the visibility of an image by changing the color of the image by heating the image formed using the decolorable recording agent (for example, decolorable toner) at the decoloring temperature. For this reason, also after the decoloring process, the decolorable recording agent remains on the sheet. Accordingly, when the decoloring temperature used for the decoloring process is determined by using the same decoloring temperature information table regardless of the number of times of execution of the decoloring process, there are cases where an image formed using the decolorable recording agent cannot be completely decolored. In such a case, an image that is visually recognizable remains on the sheet after the decoloring process, and there is a problem in reusing the sheet for the printing process. In contrast to this, the image processing apparatus 1 according to the embodiment determines a decoloring temperature used for the decoloring process by using a decoloring temperature information table that is different for each number of times of execution of the decoloring process. For this reason, also in a case where the decoloring process is repeatedly executed for one sheet by the image processing apparatus 1, the possibility that an image that is visually recognizable remains on the sheet can be reduced.

Hereinafter, a modification of the image processing apparatus 1 will be described. The original sheet read by the image processing apparatus 1 or the sheet that is a target for the decoloring process, for example, may be a sheet on which an image of characters, a picture, figures, or the like is printed and may be any arbitrary object as long as an image can be read therefrom. In addition, the image data of a document to be printed does not need to be necessarily generated by the image processing apparatus 1. For example, the image data may be input to the image processing apparatus 1 through a network or a recording medium. In addition, the image processing apparatus 1 is not limited to an image processing apparatus of the electrophotographic type that forms an image using toner but may be an image processing apparatus of an ink jet recording type. The auxiliary storage device 103 may be configured to store the decoloring temperature information table used for the decoloring process of a color-printed sheet. In the embodiment described above, while a case has been described as an example in which the printing process and the decoloring process are executed by one image processing apparatus 1, the configuration of the image processing apparatus 1 is not necessarily limited thereto. For example, it may be configured such that the image processing apparatus includes an image forming apparatus executing the printing process of an image for a sheet by using a decolorable recording agent and a decoloring apparatus other than this image forming apparatus, and the decoloring process is executed by using the decoloring apparatus. The image processing apparatus configured as such executes the printing process illustrated in FIG. 8 by using the image forming apparatus and executes the decoloring process illustrated in FIG. 9 by using the decoloring apparatus.

In the image processing apparatus 1 according to the embodiment described above, the CPU 1 is a so-called computer. The memory 105 is a computer-readable storage medium and stores a program, an OS, and the like used for realizing the function of the image processing apparatus 1. The program includes a plurality of instructions for the printing process and the decoloring process. In order to execute the printing process and the decoloring process illustrated in FIGS. 8 and 9, the CPU 1 reads the program from the memory 105 and executes the instruction by controlling the image processing unit 104 and the like. The memory 105 that is a computer-readable storage medium not only includes the RAM described above but also may include a portable medium such as a flexible disk, a magneto-optical disk, a ROM, or a CR-ROM and a storage device such as a hard disk built in a computer system.

In addition, the computer-readable recording medium storing the program may include a medium that dynamically maintains the program within a short time such as a network such as the Internet or a communication line of a case where the program is transmitted through the communication line such as a telephone line. Furthermore, the computer-readable recording medium storing the program may include a medium that maintains the program for a constant time such as a volatile memory disposed inside a computer system serving as a server or a client of a case where the program is transmitted. In addition, the program may be used for realizing a part of the function of the printing process or the decoloring process described above. Furthermore, the program may be configured such that a program installed to the image processing apparatus from the outside through the Internet or the like and a program stored in the image processing apparatus in advance are combined so as to realize the function of the printing process or the decoloring process.

According to at least one embodiment described above, the image processing apparatus determines a temperature used for the decoloring process based on the information of the printing rate that is acquired from a sheet and decolors an image printed using a decolorable recording agent by using the determined temperature. Accordingly, the image processing apparatus can execute the decoloring process of an image with the power consumption being suppressed in the decoloring process.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image processing apparatus comprising:

an image processing unit that acquires, from a sheet, information that includes a printing ratio of an image printed on the sheet;

a decoloring unit that decolors the image by heating the image at a decoloring temperature; and a control unit that determines the decoloring temperature used for a decoloring process executed by the decoloring unit based on the printing ratio.

2. The image processing apparatus according to claim 1, wherein the image processing unit acquires information included in a first printing mark printed in a first predetermined area of the sheet as the information that includes the printing ratio.

3. The image processing apparatus according to claim 2, wherein the printing ratio is a first printing ratio of a non-decolored image formed on the sheet with decolorable toner, the image processing unit calculates a second printing ratio representing a sum including the first printing ratio, and the control unit determines the decoloring temperature used for the decoloring process of the decoloring unit based on the calculated second printing ratio.

4. The image processing apparatus according to claim 3, wherein the image processing unit generates image data of a second printing mark such that the second printing mark including the calculated second printing ratio is printed in a second predetermined area of the sheet different from the first predetermined area.

5. The image processing apparatus according to claim 2, further comprising an image forming unit that prints a second printing mark in a second predetermined area of the sheet in a case where the decoloring process is executed by the decoloring unit, the second printing mark being based on the first printing ratio and a previous printing mark printed in the second predetermined area.

6. The image processing apparatus according to claim 5, wherein the image processing unit calculates a second printing ratio by adding the first printing ratio and a previous printing ratio included in the previous printing mark.

7. The image processing apparatus according to claim 6, wherein the image processing unit calculates the new second printing ratio by adding the previous printing ratio included in the previous printing mark which is a most recent printed mark among a plurality of previous printing marks and the first printing ratio.

8. The image processing apparatus according to claim 7, wherein the image processing unit generates image data of the second printing mark such that the second printing mark includes the second printing ratio and is printed at a predetermined position in the second predetermined area of the sheet, and the image forming unit prints the second printing mark at the predetermined position in the second predetermined area of the sheet based on the generated image data of the second printing mark.

9. The image processing apparatus according to claim 8, wherein the image forming unit prints the second printing mark at a position shifted by a predetermined amount from a print position of the most recently printed mark in the second predetermined area of the sheet every that the decoloring process is executed by the decoloring unit.

10. The image processing apparatus according to claim 9, further comprising a storage device that stores a decoloring temperature information table in which a printing rate and a decoloring temperature are stored in association with each other, wherein the control unit determines a decoloring temperature corresponding to the second printing ratio as the decoloring temperature used for the decoloring process by referring to the decoloring temperature information table.

11. The image processing apparatus according to claim 10, wherein the storage device stores a plurality of decoloring temperature information tables corresponding to a number of times of execution of the decoloring process, and the control unit selects a decoloring temperature information table to be referred to from among the plurality of decoloring temperature information tables based on the number of times of execution of the decoloring process that is executed on the sheet by the decoloring unit.

12. The image processing apparatus according to claim 11, wherein the image processing unit acquires the number of the second printing marks printed in the second predetermined area of the sheet, and the control unit determines the number of times of execution of the decoloring process executed by the decoloring unit based on the acquired number of the second printing marks.

13. The image processing apparatus according to claim 12, wherein the control unit selects the decoloring temperature information table to be referred to by using a number acquired by incrementing the acquired number of the second printing marks by a predetermined number as the number of times of execution of the decoloring process executed by the decoloring unit.

14. The image processing apparatus according to claim 13, wherein the image processing unit acquires image data of an original to be printed in an image formation area of the sheet, calculates the first printing ratio based on the image data of the original to be printed, and combines the first mark with the image data of the original to be printed such that the first mark including the calculated first printing ratio is printed in the first predetermined area of the sheet, and the image forming unit executes a printing process in which the first mark is printed in the first predetermined area, and an image of the original to be printed is printed in the image formation area, based on the image data with which the first mark is combined.

15. An image processing method including a decoloring process of an image, the image processing method comprising:

acquiring, from a sheet, information representing a printing ratio of an image printed on the sheet;

determining a decoloring temperature used for the decoloring process based on the acquired printing ratio; and decoloring the image by heating the image printed on the sheet at the determined decoloring temperature.

* * * * *